US009688092B2

(12) United States Patent
Niwa

(10) Patent No.: US 9,688,092 B2
(45) Date of Patent: Jun. 27, 2017

(54) REFILL FOR WRITING TOOL AND WRITING TOOL

(71) Applicant: Kuretake Co., Ltd., Nara-shi (JP)

(72) Inventor: Akina Niwa, Nara (JP)

(73) Assignee: Kuretake Co., Ltd., Nara-shi (JP)

( * ) Notice: Subject to any disclaimer, the term of this patent is extended or adjusted under 35 U.S.C. 154(b) by 0 days.

(21) Appl. No.: 14/599,805

(22) Filed: Jan. 19, 2015

(65) Prior Publication Data

US 2015/0202912 A1 Jul. 23, 2015

(30) Foreign Application Priority Data

Jan. 20, 2014 (JP) ..... 2014-007983

(51) Int. Cl.

| | |
|---|---|
| ***B43K 8/03*** | (2006.01) |
| ***B43K 8/08*** | (2006.01) |
| ***B43K 8/02*** | (2006.01) |
| ***B43K 8/04*** | (2006.01) |

(52) U.S. Cl.

CPC ..... *B43K 8/03* (2013.01); *B43K 8/02* (2013.01); *B43K 8/04* (2013.01); *B43K 8/08* (2013.01)

(58) Field of Classification Search

CPC . B43K 8/003; B43K 8/04; B43K 8/06; B43K 8/08; B43K 7/10

See application file for complete search history.

(56) References Cited

U.S. PATENT DOCUMENTS

| | | | | |
|---|---|---|---|---|
| 5,906,446 | A * | 5/1999 | McCulloch | B43K 8/08 401/198 |
| 8,128,304 | B2 * | 3/2012 | Kurita | B43K 7/10 401/198 |
| 8,408,831 | B2 * | 4/2013 | Paradise | B43K 23/00 401/48 |
| 2002/0181997 | A1 | 12/2002 | Konose | |
| 2003/0081981 | A1 | 5/2003 | Iida et al. | |
| 2004/0109721 | A1 | 6/2004 | Nowak et al. | |
| 2005/0169691 | A1 | 8/2005 | Yamada et al. | |
| 2007/0212159 | A1 | 9/2007 | Kurita et al. | |

FOREIGN PATENT DOCUMENTS

| | | | |
|---|---|---|---|
| EP | 1266770 | A1 | 12/2002 |
| EP | 1541371 | A1 | 6/2005 |
| EP | 1832442 | A1 | 9/2007 |
| JP | 200348394 | A | 2/2003 |
| JP | 2005324336 | A | 11/2005 |
| JP | 2012135982 | A | 7/2012 |

* cited by examiner

*Primary Examiner* — Jennifer C Chiang
*Assistant Examiner* — Bradley Oliver
(74) *Attorney, Agent, or Firm* — The Webb Law Firm

(57) ABSTRACT

A plurality of inlets are defined in a circulation path between an ink reservoir and an ink absorbing member by an inlet forming part formed in the circulation path.

6 Claims, 8 Drawing Sheets

REFILL FOR WRITING TOOL AND WRITING TOOL

CROSS-REFERENCE TO RELATED APPLICATION

This application claims priority to Japanese Patent Application No. 2014-007983, the disclosure of which is incorporated herein by reference in its entirety.

BACKGROUND OF THE INVENTION

Field of the Invention

The present invention relates to a refill for a writing tool and a writing tool.

Background Art

Up to now, various types of writing tools such as a brush-like pen, a ballpoint pen, and a fountain pen have been provided. For example, as illustrated in FIG. 8, one of the writing tools includes: a cylindrical barrel 40 that forms the exterior of the writing tool; an ink reservoir 41 that stores liquid ink inside of the barrel 40; and a pen tip part 42 that is exposed from the barrel 40 and includes a writing part 420 (penpoint) at its leading end, the liquid ink being supplied from the ink reservoir 41 to the writing part 420.

In a writing tool 4 of this type, the barrel 40 is elongated in one direction. Moreover, a space opened on one side in the longitudinal direction is formed in the barrel 40.

The writing tool 4 includes: an ink absorbing member 43 that is connected to the ink reservoir 41 and absorbs and retains the liquid ink from the ink reservoir 41; a collector 44 that is interposed between the ink absorbing member 43 and the pen tip part 42 and holds the liquid ink in the ink absorbing member 43 due to a capillary action, to thereby achieve a supply balance of the liquid ink in the ink absorbing member 43; and an ink guiding member 45 that is inserted through the collector 44 and guides the liquid ink absorbed by the ink absorbing member 43 to the writing part 420 of the pen tip part 42 (see, for example, Japanese Patent Laid-Open No. 2012-135982).

Hence, in the writing tool 4, the ink absorbing member 43 absorbs and retains the liquid ink from the inside of the ink reservoir 41. Then, the collector 44 holds the liquid ink in the ink absorbing member 43 due to the capillary action. In this way, the supply balance of the liquid ink in the ink absorbing member 43 is achieved in the writing tool 4. Accordingly, the writing tool 4 can prevent the liquid ink supplied to the writing part 420 from becoming insufficient while preventing the liquid ink from leaking and dripping from the writing part 420.

Meanwhile, in the writing tool 4, as described above, the liquid ink absorbed by the ink absorbing member 43 flows out from the writing part 420. Hence, for example, if circulation of the liquid ink from the ink reservoir 41 to the ink absorbing member 43 stops, only the liquid ink held by the ink absorbing member 43 is supplied to the collector 44. In this case, the amount of liquid ink that flows out from the writing part 420 of the pen tip part 42 decreases.

Hence, in the writing tool 4, the liquid ink cannot be supplied to the writing part 420 of the pen tip part 42 at an optimal liquid amount for writing in some cases.

In view of such actual circumstances as described above, it is an object of the present invention to provide a refill for a writing tool and a writing tool in which: a flow of liquid ink from an ink reservoir to an ink absorbing member is made smooth; and the liquid ink can thus be supplied to a writing part of a pen tip part at an optimal liquid amount for writing.

SUMMARY OF THE INVENTION

In order to clarify basic understanding concerning some features of the present invention, a brief summary of the present invention is described below. This summary is not intended to describe the outline of extension of the present invention. This summary is not intended to specify main or important elements of the present invention and limit the scope of the present invention. This summary is merely intended to present some basic concepts of the present invention in a simplified manner as introductory remarks to the subsequent more detailed description.

A refill for a writing tool according to the present invention includes: an ink reservoir that stores liquid ink; a pen tip part including a writing part at a leading end thereof the liquid ink being supplied from the ink reservoir to the writing part; an ink absorbing member that is connected to the ink reservoir and absorbs and retains the liquid ink from the ink reservoir; a collector that is interposed between the ink absorbing member and the pen tip part and holds the liquid ink from the ink absorbing member due to a capillary action, to thereby achieve a supply balance of the liquid ink in the ink absorbing member; an ink guiding member that is provided so as to penetrate through the collector and guides the liquid ink absorbed by the ink absorbing member to the writing part of the pen tip part; and an inlet forming part that is formed in a circulation path between the ink reservoir and the ink absorbing member and defines a plurality of inlets in the circulation path. The refill is inserted into a barrel that forms an exterior of the writing tool.

According to an aspect of the refill for the writing tool of the present invention, the inlet forming part may include at least one partition part that partitions an inside of the circulation path into a plurality of regions, and the plurality of inlets may be respectively formed by the plurality of regions that are partitioned by the at least one partition part in the circulation path.

According to another aspect of the refill for the writing tool of the present invention, the partition part may extend in a direction orthogonal to a central line of the circulation path.

A writing tool according to the present invention includes: an ink reservoir that stores liquid ink; a pen tip part including a writing part at a leading end thereof; the liquid ink being supplied from the ink reservoir to the writing part; an ink absorbing member that is connected to the ink reservoir and absorbs and retains the liquid ink from the ink reservoir; a collector that is interposed between the ink absorbing member and the pen tip part and holds the liquid ink from the ink absorbing member due to a capillary action, to thereby achieve a supply balance of the liquid ink in the ink absorbing member; an ink guiding member that is provided so as to penetrate through the collector and guides the liquid ink absorbed by the ink absorbing member to the writing part of the pen tip part; and an inlet forming part that is formed in a circulation path between the ink reservoir and the ink absorbing member and defines a plurality of inlets in the circulation path.

According to an aspect of the writing tool of the present invention, the inlet forming part may include at least one partition part that partitions an inside of the circulation path into a plurality of regions, and the plurality of inlets may be respectively formed by the plurality of regions that are partitioned by the at least one partition part in the circulation path.

According to another aspect of the writing tool of the present invention, the partition part may extend in a direction orthogonal to a central line of the circulation path.

DETAILED DESCRIPTION OF THE PREFERRED EMBODIMENT

Hereinafter, a writing tool according to an embodiment of the present invention is described with reference to the attached drawings.

Figure 1:
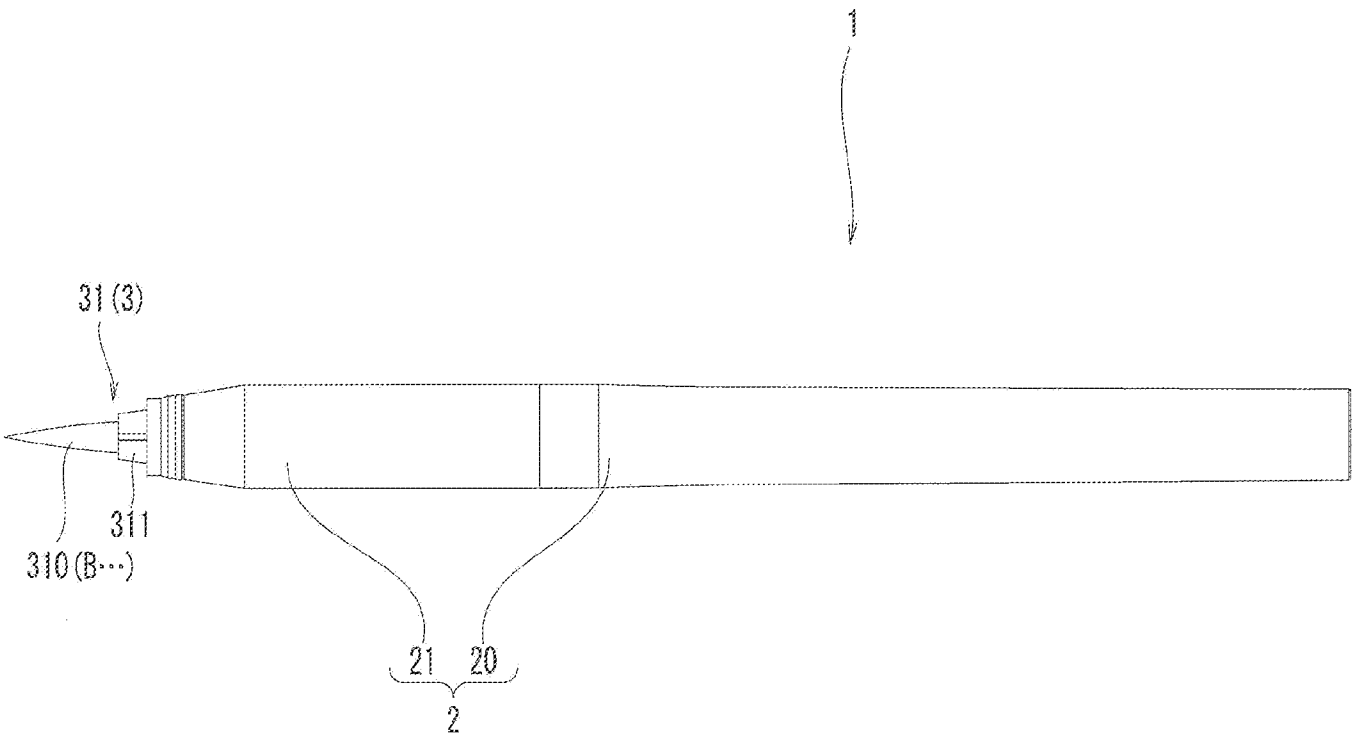
FIG. 1 is an overall view of a writing tool according to an embodiment of the present invention.

As illustrated in FIG. 1, a pen tip part 31 is fixed to one end of a barrel 2 that forms the exterior of the writing tool.

Figure 2:
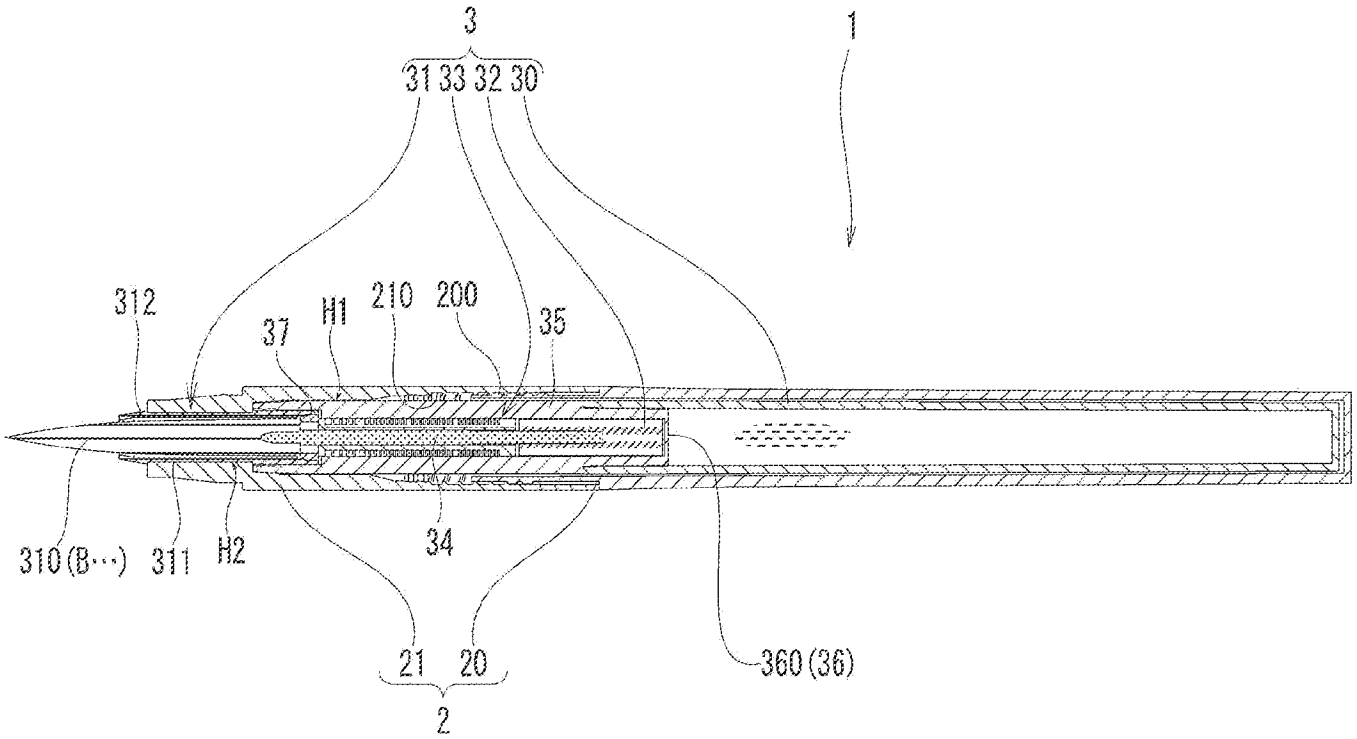
FIG. 2 is an overall cross-sectional view of the writing tool according to the embodiment.

More specific description thereof is given. As illustrated in FIG. 2, the writing tool according to the present embodiment includes the cylindrical barrel 2 and a refill for the writing tool (hereinafter, simply referred to as a refill) 3 attached to the barrel 2.

The barrel 2 may be formed of one cylindrical body. In the present embodiment, the one end of the barrel 2 is separable.

Moreover, the barrel 2 is elongated in one direction, and a space opened on one side in the longitudinal direction is formed in the barrel 2. More specific description thereof is given. The barrel 2 includes a barrel body 20 formed in a cylindrical shape. The barrel body 20 is opened at only one end in the axial direction. With this configuration, the barrel 2 includes a leading-end tube 21 detachably attached to the one end of the barrel body 20.

The barrel body 20 is made of a resin molded article. Moreover, a male screw 200 is formed on the outer circumference on the one end side of the barrel body 20.

The leading-end tube 21 is formed in a cylindrical shape. That is, the leading-end tube 21 is opened at both ends in the axial direction. Note that, in the present embodiment, the following description is given assuming that an end part on one end side of the leading-end tube 21 is one end and that an end part on the other end side thereof is another end.

Further, the outer diameter of the leading-end tube 21 is set such that the leading-end tube 21 is tapered from the one end side toward the other end side in its external appearance. A female screw 210 is formed on the inner circumference of the one end part of the leading-end tube 21. Hence, the female screw 210 is engaged with the male screw 200 of the barrel body 20, whereby the leading-end tube 21 is concentrically coupled to the barrel body 20.

An internal hole of the leading-end tube 21 is stepped. A hole H1 on the one end side of the leading-end tube 21 is larger in diameter than a hole H2 on the other end side thereof. In the present embodiment, an adjusting member holder 35 to be described later is press-fitted into the large-diameter hole H1 of the leading-end tube 21. Moreover, the pen tip part 31 (pen tip holder 311) is inserted through the small-diameter hole H2 of the leading-end tube 21. With this configuration, the leading-end tube 21 according to the present embodiment is fixedly attached to the adjusting member holder 35. Hence, the leading-end tube 21 constitutes part of the barrel 2 while constituting part of the refill 3.

The refill 3 includes: an ink reservoir 30 that stores liquid ink; the pen tip part 31 including a writing part 310 at its leading end, the liquid ink being supplied from the ink reservoir 30 to the writing part 310; an ink absorbing member 32 that is connected to the ink reservoir 30 and absorbs and retains the liquid ink from the ink reservoir 30; a collector 33 that is interposed entirely between the ink absorbing member 32 and the pen tip part 31 and holds the liquid ink from the ink absorbing member 32 due to a capillary action, to thereby achieve a supply balance of the liquid ink in the ink absorbing member 32; and an ink guiding member 34 that is provided so as to penetrate through the collector 33 and guides the liquid ink absorbed by the ink absorbing member 32 to the writing part 310 of the pen tip part 31.

The refill 3 further includes the adjusting member holder 35 formed in a cylindrical shape. The adjusting member holder 35 has: a first open end continuous with the inside of the ink reservoir 30; and a second open end opposite to the first open end. The ink absorbing member 32 and the collector 33 are placed inside of the adjusting member holder 35.

The refill 3 further includes an inlet forming part 36 that is formed in a circulation path between the ink reservoir 30 and the ink absorbing member 32 and defines a plurality of inlets R in the circulation path.

The ink reservoir 30 liquid-tightly defines a space in which the liquid ink is stored. The inside of the ink reservoir 30 is filled with the liquid ink having flowability and low viscosity.

More specific description thereof is given. The ink reservoir 30 is elongated in one direction. A space opened on one side in the longitudinal direction is formed in the ink reservoir 30. In other words, the ink reservoir 30 is formed in a cylindrical shape. The ink reservoir 30 is closed at one end in the axial direction. The ink reservoir 30 is opened at the other end in the axial direction.

Then, the adjusting member holder 35 that holds the ink absorbing member 32 is connected to the other end part of the ink reservoir 30. This makes the inside of the ink reservoir 30 liquid-tight. Hence, the ink reservoir 30 can be maintained in the state where the inside thereof is filled with the liquid ink. Note that any liquid ink can be adopted for the writing tool according to the present embodiment, as long as the adopted liquid ink has flowability. Not to mention various inks such as aqueous ink and fluorescent ink containing pigments, in the case where the writing tool 1 is a brush-like pen, Indian ink is adopted as the liquid ink.

Figure 3:
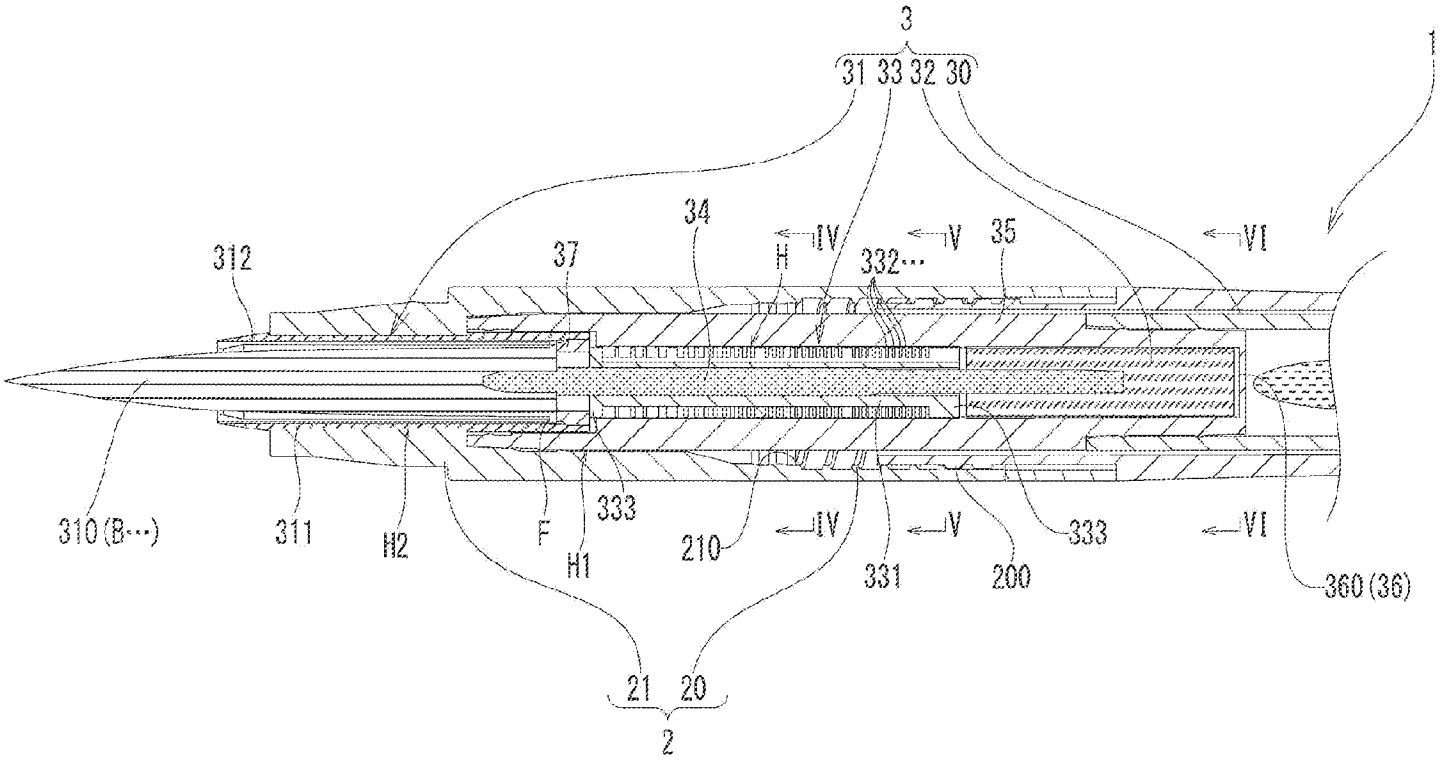
FIG. 3 is a partial enlarged cross-sectional view of the writing tool according to the embodiment and is a partial enlarged cross-sectional view including a pen tip part, an ink absorbing member, and a collector.

As illustrated in FIG. 3, the pen tip part 31 includes: the writing part 310 that can hold the supplied liquid ink; and the pen tip holder 311 that holds the writing part 310.

The writing part 310 is made of a felt chip, a hair bundle, or the like that can hold the liquid ink due to capillary force or liquid absorption force, or is made of a member that allows the liquid ink to adhere to its outer surface. In the present embodiment, the writing part 310 is made of a hair bundle obtained by bundling a plurality of hairs B. Each of the plurality of hairs B is a resin fiber. Respective one ends of the plurality of hairs B are integrally welded. In this way, in the writing part 310, the plurality of hairs B form the hair bundle. Further, in the writing part 310, the respective one ends of the plurality of hairs B are welded, whereby a flange F is formed. The flange F protrudes outward in the radial direction of the hair bundle.

The pen tip holder 311 is formed in a cylindrical shape. Moreover, the writing part 310 is inserted through the pen tip holder 311. Hence, the leading end of the writing part 310 protrudes from the inside of the pen tip holder 311 to the outside of the pen tip holder 311. The pen tip holder 311 is press-fitted into one end part of the adjusting member holder 35. With this configuration, the pen tip holder 311 is fixed to the adjusting member holder 35. In the writing tool 1 according to the present embodiment, as described above, the leading-end tube 21 of the barrel 2 constitutes part of the refill 3. Hence, a stopper 312 that protrudes outward in the radial direction is formed in the leading end part of the pen tip holder 311. The leading end of the leading-end tube 21 is sandwiched between the stopper 312 and the leading end of the adjusting member holder 35, whereby the leading-end tube 21 is fixed.

In the refill 3 according to the present embodiment, the ink absorbing member 32 and the collector 33 are held by the common adjusting member holder 35. As described above, the adjusting member holder 35 is formed in the cylindrical shape opened at both the ends. The first open end of the adjusting member holder 35 is concentrically press-fitted into the other end part (opened end part) of the ink reservoir 30 (cylindrical body), whereby the adjusting member holder 35 is liquid-tightly connected to the ink reservoir 30.

The ink absorbing member 32 is made of a fiber material having water absorbability, such as cotton and felt. Moreover, the ink absorbing member 32 fills a predetermined range on the one end side of the adjusting member holder 35. The largest amount of liquid ink absorbed by the ink absorbing member 32 according to the present embodiment is set to be smaller than the largest amount of liquid ink stored in the ink reservoir 30. In the present embodiment, the largest amount of liquid ink absorbed by the ink absorbing member 32 is set to be 0.03 times to 0.15 times the largest amount of liquid ink stored in the ink reservoir 30.

The collector 33 includes: a main shaft part 331 in which a through-hole H for providing the ink guiding member 34 therethrough is pierced on its central line; and a plurality of partition blades 332 that are placed at intervals in the axial direction of the main shaft part 331 and protrude from the outer surface of the main shaft part 331. Flange parts 333 that protrude outward in the radial direction are respectively formed in both end parts of the main shaft part 331. Moreover, the plurality of partition blades 332 are provided to the main shaft part 331 so as to protrude from the outer surface between the two flange parts 333.

Each of the plurality of partition blades 332 protrudes from substantially the entire circumference of the main shaft part 331, and has an annular shape. The intervals of the plurality of partition blades 332 are set such that the liquid ink flows into between adjacent ones of the partition blades 332 due to capillary force. In general, the intervals of the plurality of partition blades 332 are set to become wider toward the other end side in the axial direction of the main shaft part 331.

Figure 4:
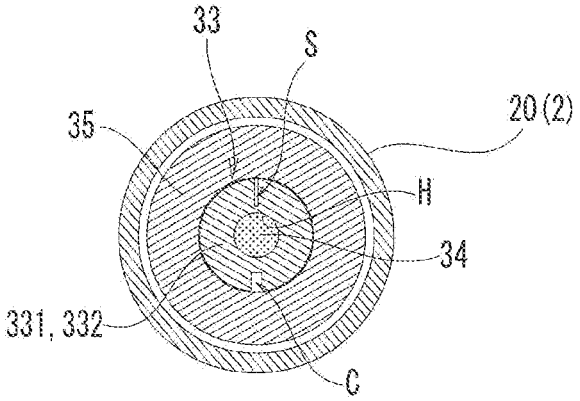
FIG. 4 is a partial enlarged cross-sectional view of the writing tool according to the embodiment and is a cross-sectional view taken along a line IV-IV in FIG. 3.
Figure 5:
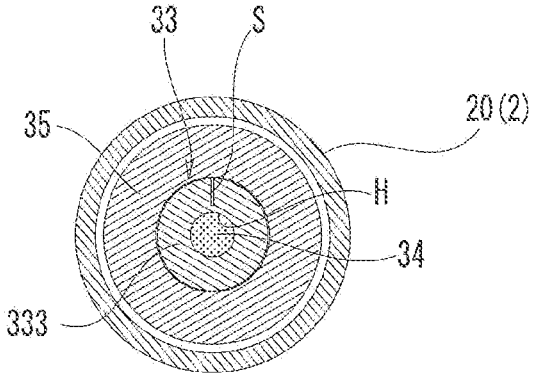
FIG. 5 is a partial enlarged cross-sectional view of the writing tool according to the embodiment and is a cross-sectional view taken along a line V-V in FIG. 3.

As illustrated in FIG. 4 and FIG. 5, a slit S that extends in the protruding direction from the main shaft part 331 is formed in each of one of the flange parts 333 and the plurality of partition blades 332. The slits S that are respectively formed in the one flange part 333 and the plurality of partition blades 332 are aligned in the axial direction of the main shaft part 331. Note that, in the writing tool 1 (collector 33) according to the present embodiment, the slit S is formed so as to enter the main shaft part 331 beyond the partition blade 332.

Moreover, as illustrated in FIG. 4, a cutout part C for air exchange is provided to each of the plurality of partition blades 332, at a position that is shifted from the slit S in the circumferential direction of the partition blade 332. The cutout part C is formed by cutting out the partition blade 332 from the leading end to the base end (toward the main shaft part 331) in the protruding direction. Moreover, the opening area of the cutout part C viewed in the axial direction of the main shaft part 331 is set to be wider than that of the slit S.

As illustrated in FIG. 3, in the state where the one flange part 333 is opposed to the ink absorbing member 32, the collector 33 is fitted in the adjusting member holder 35 so as to be located at a position closer to the other end side than the ink absorbing member 32. That is, in the state where the one flange part 333 is close to the ink absorbing member 32, the collector 33 is fitted in the adjusting member holder 35. Accordingly, the slit S of the one flange part 333 is opposed to the ink absorbing member 32.

Note that, although not illustrated, in the writing tool 1, the inside and the outside of the adjusting member holder 35 are communicated with each other at a position closer to the other end side than the position at which the collector 33 is fitted in, and hence air can be taken in from the outside. That is, if the adjusting member holder 35 is sealed, when the internal pressure becomes lower along with consumption of the liquid ink, the liquid ink cannot be supplied to the writing part 310. Hence, in the writing tool 1, air can be taken into the adjusting member holder 35 from the outside.

The ink guiding member 34 is a so-called relay core. More specific description thereof is given. The ink guiding member 34 is entirely provided with water absorbability. The ink guiding member 34 is formed in a rod-like shape. That is, the ink guiding member 34 is made of a material having excellent liquid absorbability (such as a resin molded article in which continuous bubbles are formed and a fiber material such as felt), and the ink guiding member 34 is formed by molding the material in the rod-like shape having a length across the ink absorbing member 32 and the pen tip part 31 (writing part 310).

In the state where the ink guiding member 34 is inserted in the through-hole H of the collector 33 (main shaft part 331), one end of the ink guiding member 34 is inserted in the ink absorbing member 32 (made of cotton or the like), and the other end thereof is inserted in the pen tip part 31 (writing part 310). Note that, in the writing tool 1 according to the present embodiment, an annular spacer 37 is interposed between the writing part 310 and the collector 33. Moreover, the other end of the ink guiding member 34 is inserted in the writing part 310 while being inserted through the spacer 37. With this configuration, the ink guiding member 34 can supply the liquid ink absorbed by the ink absorbing member 32 to the writing part 310.

Figure 6:
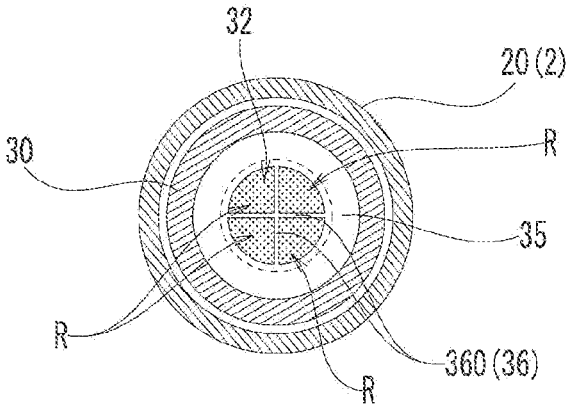
FIG. 6 is a partial enlarged cross-sectional view of the writing tool according to the embodiment and is a cross-sectional view taken along a line VI-VI in FIG. 3.

As illustrated in FIG. 6, the inlet forming part 36 includes at least one partition part 360 that partitions the inside of the circulation path into a plurality of regions. In the writing tool 1 according to the present embodiment, the inner circumference of the first open end of the adjusting member holder 35 defines the circulation path. Hence, the inlet forming part 36 includes at least one (in the present embodiment, two) partition part 360 that partitions the first open end of the adjusting member holder 35 into the plurality of regions.

Each of the two partition parts 360 extends in a direction orthogonal to the central line of the first open end of the adjusting member holder 35. Hence, in the present embodiment, the plurality of inlets R are respectively formed by the plurality of regions that are partitioned by the two partition parts 360 inside of the first open end of the adjusting member holder 35. Further, the two partition parts 360 abut against the ink absorbing member 32. That is, the inlet forming part 36 is configured such that a gap does not occur between the two partition parts 360 and the ink absorbing member 32. With this configuration, in the writing tool 1, movement of the ink absorbing member 32 toward the ink reservoir 30 is restricted by the inlet forming part 36 (partition parts 360).

The writing tool 1 according to the present embodiment is as described above. In the refill 3 of the writing tool 1, the ink absorbing member 32 is connected to the ink reservoir 30. Hence, the liquid ink in the ink reservoir 30 flows into the adjusting member holder 35 through the plurality of inlets R.

Then, after the liquid ink in the ink reservoir 30 flows into the adjusting member holder 35 through the plurality of inlets R, the ink absorbing member 32 absorbs and retains the liquid ink. Hence, while the liquid ink remains in the ink reservoir 30, the ink absorbing member 32 absorbs and retains the liquid ink at the largest occlusion amount. That is, in the refill 3 of the writing tool 1, while the liquid ink remains in the ink reservoir 30, the ink absorbing member 32 is saturated with the liquid ink.

In this way, in the refill 3 of the writing tool 1, the liquid ink absorbed by the ink absorbing member 32 is supplied to the writing part 310 (pen tip part 31) through the ink guiding member 34.

Moreover, in the refill 3 of the writing tool 1, the largest amount of liquid ink absorbed by the ink absorbing member 32 is set to be smaller than the largest amount of liquid ink stored in the ink reservoir 30. Hence, in the refill 3 of the writing tool 1, while the liquid ink remains in the ink reservoir 30, the ink absorbing member 32 is abundant in the liquid ink regardless of the amount of remaining liquid ink. Accordingly, the ink absorbing member 32 is saturated with the liquid ink.

In particular, because the largest amount of liquid ink absorbed by the ink absorbing member 32 is 0.03 times to 0.15 times the largest amount of liquid ink stored in the ink reservoir 30, the amount of liquid ink stored in the ink reservoir 30 is remarkably larger than the amount of liquid ink absorbed by the ink absorbing member 32. Hence, in the refill 3 of the writing tool 1, the ink absorbing member 32 is abundant in the liquid ink until or until just before the liquid ink in the ink reservoir 30 is used up from the beginning of use, and satisfactory writing is possible until no liquid ink or almost no liquid ink remains.

In this way, in the refill 3 of the writing tool 1, only the liquid ink absorbed by the ink absorbing member 32 is sequentially supplied to the writing part 310, and hence the writing part 310 is abundant in the liquid ink. Moreover, in the refill 3 of the writing tool 1, the liquid ink is not excessively supplied to the writing part 310, unlike a conventional writing tool 1 and a conventional refill 3 in which the pen tip part 31 is directly connected to the ink reservoir 30.

Further, in the refill 3 of the writing tool 1, a supply balance of the liquid ink in the ink absorbing member 32 is achieved by the collector 33 interposed between the ink absorbing member 32 and the pen tip part 31. That is, in the refill 3 of the writing tool 1, an amount of liquid ink exceeding the largest occlusion amount of the ink absorbing member 32 is held by the collector 33, and the liquid ink held by the collector 33 is returned to the ink absorbing member 32, whereby the supply balance of the liquid ink in the ink absorbing member 32 is achieved.

More specific description thereof is given. In the refill 3 of the writing tool 1, if the liquid ink remains in the ink reservoir 30 in the state where the ink absorbing member 32 is saturated with the liquid ink, the liquid ink may flow out from the ink absorbing member 32 to the pen tip part 31. In this regard, in the refill 3 according to the present embodiment, the collector 33 can hold the liquid ink in the ink absorbing member 32 due to a capillary action. Hence, the refill 3 can prevent the liquid ink from being supplied to the pen tip part 31 more than necessary.

In the collector 33 of the refill 3 according to the present embodiment, the slits S are respectively formed in the plurality of partition blades 332 and the one flange part 333 that are provided so as to protrude from the outer circumference of the main shaft part 331, and the slits S are aligned in the axial direction of the main shaft part 331. Hence, the liquid ink that flows out from the ink absorbing member 32 is drawn into the collector 33 due to a capillary action of the slits S (the plurality of aligned slits S) formed in the one flange part 333 and the partition blades 332. Then, the liquid ink drawn into the collector 33 is drawn into between adjacent ones of the plurality of partition blades 332 due to capillary force between adjacent ones of the partition blades 332.

In this way, an amount of liquid ink exceeding the largest occlusion amount of the ink absorbing member 32 (the liquid ink that overflows from the ink absorbing member 32) is held by the collector 33. As a result, the liquid ink that is about to overflow from the ink absorbing member 32 is guided by the ink guiding member 34 so as not to be guided to the writing part 310.

Then, in the refill 3 of the writing tool 1, as described above, the liquid ink held by the collector 33 can be returned to the ink absorbing member 32, whereby an appropriate amount of ink can be supplied from the ink absorbing member 32 to the writing part 310 through the ink guiding member 34. More specific description thereof is given. In the refill 3 of the writing tool 1, the collector 33 is placed in a region that is open to the atmosphere, and the cutout part C is provided to each partition blade 332 at a position different from that of the slit S. Hence, in the refill 3 of the writing tool 1, the liquid ink held by the collector 33 is returned to the ink absorbing member 32 from the slits S and thereby can be supplied to the writing part 310 through the ink guiding member 34.

Accordingly, the refill 3 of the writing tool 1 can supply the liquid ink to the writing part 310 provided at the leading end of the pen tip part 31 at an optimal liquid amount for writing, while reliably preventing the liquid ink from leaking and dripping from the writing part 310.

Moreover, in the present embodiment, the refill 3 of the writing tool 1 includes the inlet forming part 36 that defines the plurality of inlets R in the circulation path. That is, in the refill 3 of the writing tool 1, the inlet forming part 36 defines, in the circulation path, the plurality of inlets R each having a flow path area smaller than that of the circulation path.

Hence, in the refill 3 of the writing tool 1, the liquid ink in the ink reservoir 30 can be circulated in given circulation port(s) of the plurality of inlets R, while air that enters the pen tip part 31 can be circulated in circulation port(s) other than the given circulation port(s).

If ir from the outside enters the ink reservoir 30 from the pen tip part 31 in this way, the air replaces the liquid ink in the ink reservoir 30. That is, the liquid ink in the ink reservoir 30 is pushed out of the ink reservoir 30 by the air that enters from the outside. As a result, in the refill 3 of the writing tool 1, the inside of the ink reservoir 30 is suppressed from coming into a negative pressure state, whereby the liquid ink can flow out from the pen tip part 31 without any interruption.

Moreover, in the refill 3 of the writing tool 1, each partition part extends in a direction orthogonal to the central line of the circulation path, and hence the plurality of inlets R can be placed in the circulation path in a balanced manner. Moreover, the respective areas of the plurality of inlets R can be equal or substantially equal to one another. As a result, in the refill 3 of the writing tool 1, the liquid ink can be supplied to the ink absorbing member 32 in a balanced manner.

Accordingly, in the refill 3 of the writing tool 1, a flow of the liquid ink from the ink reservoir 30 to the ink absorbing member 32 can be made smooth, and the liquid ink can thus be supplied to the writing part of the pen tip part 31 at an optimal liquid amount for writing.

Note that the present invention is not limited to the above-mentioned embodiment, and can be changed as appropriate in a range not departing from the gist of the present invention as a matter of course.

Figure 7:
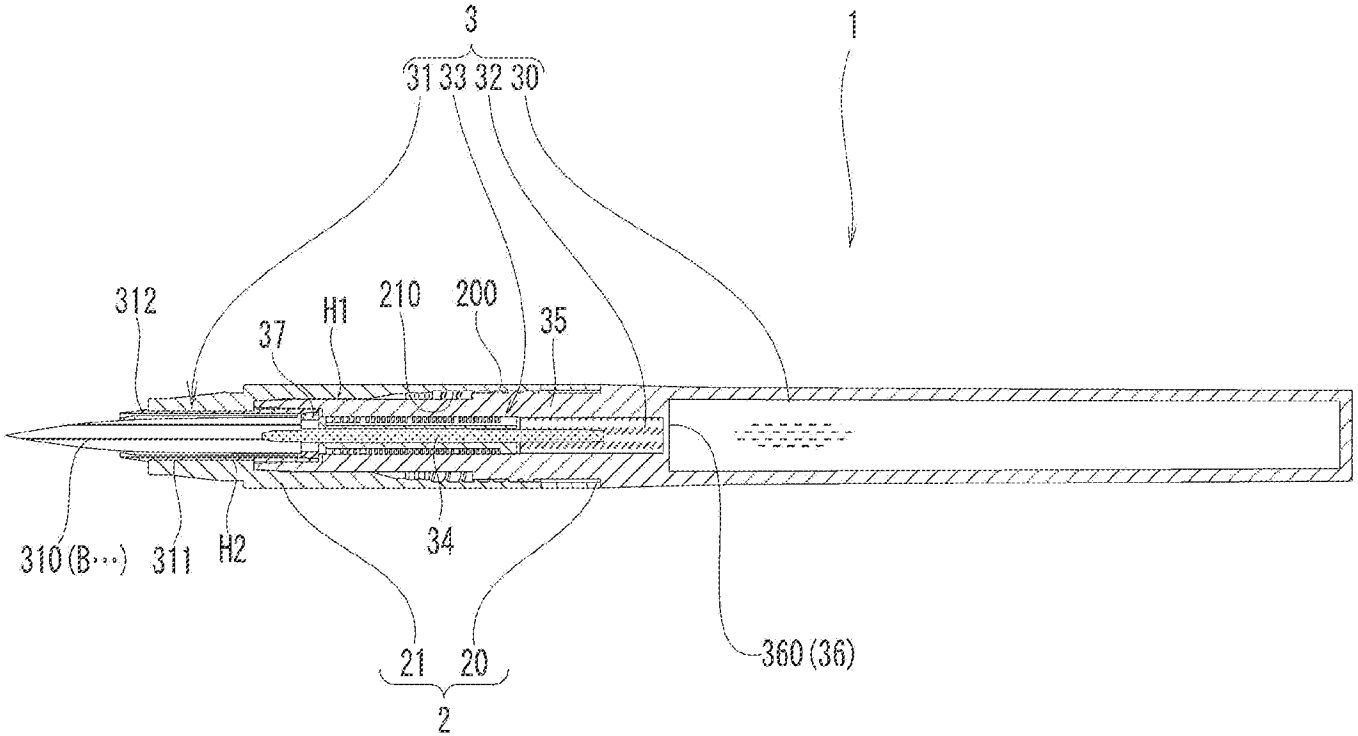
FIG. 7 is an overall cross-sectional view of a writing tool according to another embodiment of the present invention.
Figure 8:
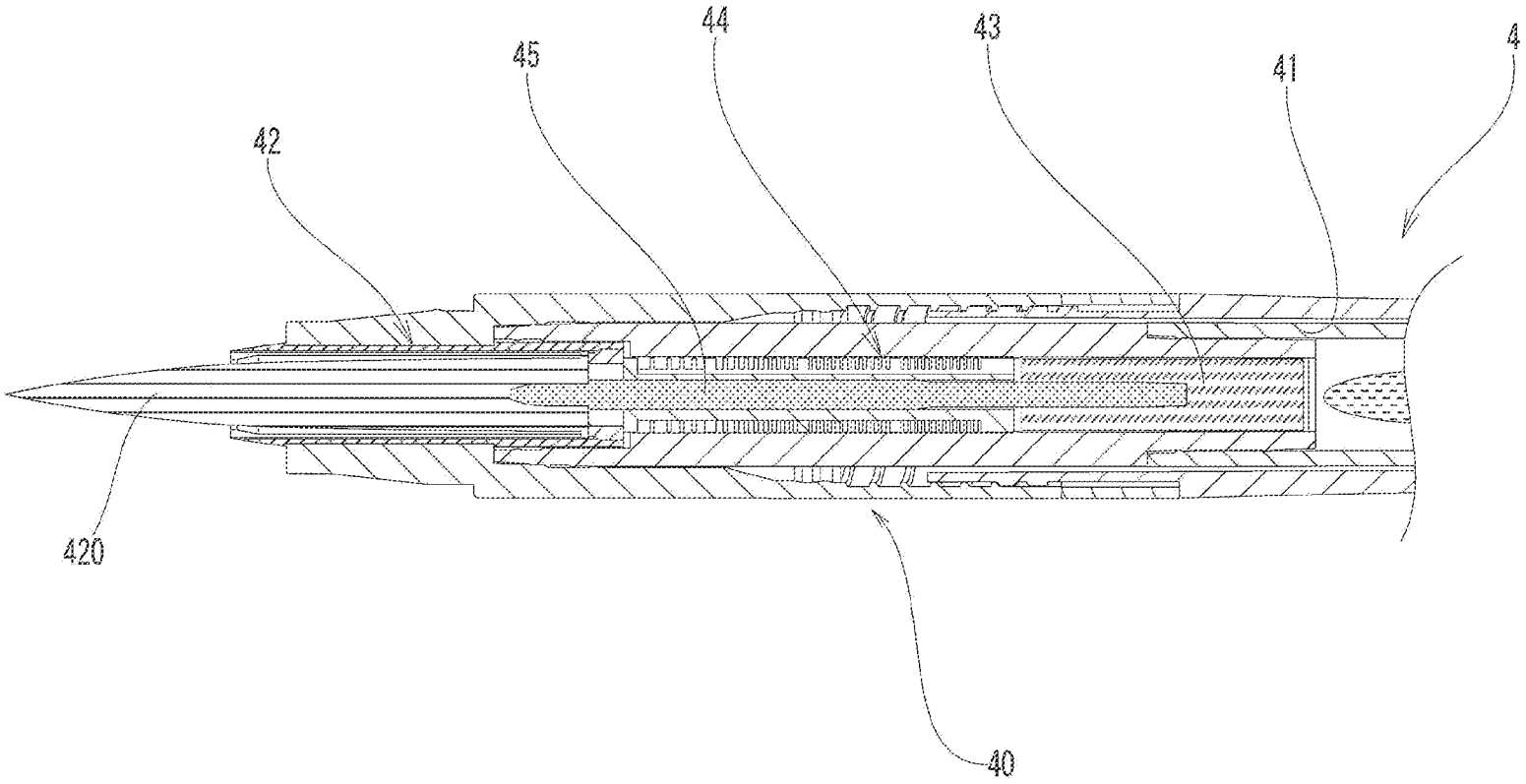
Fig. 8 PRIOR ART
FIG. 8 is a partial enlarged cross-sectional view of a conventional writing tool and is a partial enlarged cross-sectional view including a pen tip part, an ink absorbing member, and a collector.

In the above-mentioned embodiment, the ink reservoir 30, the pen tip part 31, the ink absorbing member 32, and the collector 33 are provided to the refill 3 attached to the barrel 2 that forms the exterior of the writing tool 1, but the present invention is not limited thereto. For example, as illustrated in FIG. 7, the outer diameters of the ink reservoir 30 and the adjusting member holder 35 may be respectively set to outer diameters suitable for a grip of a user, the ink reservoir 30 and the adjusting member holder 35 may constitute the barrel 2 that forms the exterior of the writing tool 1, and the writing tool 1 may be achieved by only such a configuration.

In the above-mentioned embodiment, the writing part 310 of the pen tip part 31 is made of the hair bundle, but the present invention is not limited thereto. For example, the writing part 310 may be made of a felt chip as described above, and may be made of a ball rotatably attached to the pen tip holder 311. Moreover, the pen tip part 31 may be made of a pen tip of a fountain pen as a matter of course. That is, the present invention can be applied to any type of pen as long as the pen includes: the ink reservoir 30 that stores the liquid ink; and the pen tip part 31 to which the liquid ink stored in the ink reservoir 30 is supplied.

In the above-mentioned embodiment, the first open end of the adjusting member holder 35 is partitioned by the two partition parts 360, but the present invention is not limited thereto. For example, the number of the partition parts 360 may be one or three or more.

In the above-mentioned embodiment, the inlet forming part 36 (partition parts 360) is formed integrally with the adjusting member holder 35, but the present invention is not limited thereto. For example, the inlet forming part 36 may be formed by placing a member separate from the adjusting member holder 35 adjacently to the first open end of the adjusting member holder 35.

In the above-mentioned embodiment, the inlet forming part 36 includes the partition parts 360 that partition the first open end of the adjusting member holder 35 into the plurality of regions, but the present invention is not limited thereto. For example, the inlet forming part 36 may include a cover that closes the first open end of the adjusting member holder 35 and has a plurality of through-holes formed therein. In this case, it is preferable that the plurality of through-holes be formed over the entire cover evenly or in a balanced manner.

In the above-mentioned embodiment, the ink reservoir 30 and the adjusting member holder 35 are molded as separate members, and the separate members are coupled to each other, but the present invention is not limited thereto. For example, the ink reservoir 30 and the adjusting member holder 35 may be molded integrally with each other. Alternatively, a portion that holds the ink absorbing member 32 and a portion that holds the collector 33 may be formed dividedly from each other as the adjusting member holder 35, and the divided portions as the adjusting member holder 35 may be coupled to each other. Then, the adjusting member holder 35 thus obtained may be coupled to the ink reservoir 30.

In the above-mentioned embodiment, the barrel 2 includes the barrel body 20 and the leading-end tube 21, and the leading-end tube 21 also constitutes part of the refill 3, but the present invention is not limited thereto. For example, the leading-end tube 21 may be independent of the refill 3. That is, after the refill 3 is inserted into the barrel body 20, the leading-end tube 21 may be screwed with the barrel body 20. In this case, the leading-end tube 21 is configured to maintain the state where at least the writing part 310 of the pen tip part 31 is exposed to the outside, while blocking the refill 3 from coming out of the barrel body 20, in the state where the leading-end tube 21 is screwed with the barrel body 20.

In the above-mentioned embodiment, the largest amount of liquid ink absorbed by the ink absorbing member 32 is set to be smaller than the largest amount of liquid ink stored in the ink reservoir 30, but the present invention is not limited thereto. For example, the largest amount of liquid ink absorbed by the ink absorbing member 32 may be set to be equal to the largest amount of liquid ink stored in the ink reservoir 30, and the largest amount of liquid ink absorbed by the ink absorbing member 32 may be set to be larger than the largest amount of liquid ink stored in the ink reservoir 30.

In this case, in an initial stage (in the case where the amount of liquid ink remaining in the ink reservoir 30 is substantially equal to the largest storage amount and where the amount of liquid ink absorbed by the ink absorbing member 32 is the largest occlusion amount), the ink absorbing member 32 is abundant in the liquid ink, but the liquid ink in the ink reservoir 30 is gradually absorbed by the ink absorbing member 32 along with consumption of the liquid ink by writing, and the entire liquid ink in the ink reservoir 30 is absorbed by the ink absorbing member 32 in an early stage.

Consequently, the ink reservoir 30 becomes empty, and the liquid ink exists in only the ink absorbing member 32.

Hence, the situation in which the supply of the liquid ink to the writing part 310 is made more difficult by the water absorbability of the ink absorbing member 32 acting as a resistance occurs in an early stage. Accordingly, in order to appropriately supply the liquid ink to the writing part 310 until no stored liquid ink or almost no stored liquid ink remains, similarly to the above-mentioned embodiment, it is preferable that the largest amount of liquid ink absorbed by the ink absorbing member 32 be set to be smaller than the largest amount of liquid ink stored in the ink reservoir 30, and it is more preferable that the largest amount of liquid ink absorbed by the ink absorbing member 32 be set to be 0.03 times to 0.15 times (whose median is 0.09 times) the largest amount of liquid ink stored in the ink reservoir 30.

What is claimed is:

1. A refill for a writing tool, comprising:

an ink reservoir that stores liquid ink;

a pen tip part including a writing part at a leading end thereof, the liquid ink being supplied from the ink reservoir to the writing part;

an ink absorbing member that is connected to the ink reservoir and is configured to absorb and retain the liquid ink from the ink reservoir;

a collector that is interposed entirely between the ink absorbing member and the pen tip part and holds the liquid ink from the ink absorbing member due to a capillary action, to thereby achieve a supply balance of the liquid ink in the ink absorbing member;

an ink guiding member that is provided so as to penetrate through the collector and guides the liquid ink absorbed from the ink reservoir and retained by the ink absorbing member to the writing part of the pen tip part; and an inlet forming part that is formed in a circulation path that is placed between the ink reservoir and the ink absorbing member and is configured to circulate the liquid ink from the ink reservoir to the ink absorbing member, the inlet forming part defining a plurality of inlets in the circulation path, wherein the refill is inserted into a barrel that forms an exterior of the writing tool.

2. The refill for the writing tool according to claim 1, wherein the inlet forming part includes at least one partition part that partitions an inside of the circulation path into a plurality of regions, and the plurality of inlets are respectively formed by the plurality of regions that are partitioned by the at least one partition part in the circulation path.

3. The refill for the writing tool according to claim 2, wherein the partition part extends in a direction orthogonal to a central line of the circulation path.

4. A writing tool comprising:

an ink reservoir that stores liquid ink;

a pen tip part including a writing part at a leading end thereof, the liquid ink being supplied from the ink reservoir to the writing part;

an ink absorbing member that is connected to the ink reservoir and is configured to absorb and retain the liquid ink from the ink reservoir, a collector that is interposed entirely between the ink absorbing member and the pen tip part and holds the liquid ink from the ink absorbing member due to a capillary action, to thereby achieve a supply balance of the liquid ink in the ink absorbing member;

an ink guiding member that is provided so as to penetrate through the collector and guides the liquid ink absorbed from the ink reservoir and retained by the ink absorbing member to the writing part of the pen tip part; and an inlet forming part that is formed in a circulation path that is placed between the ink reservoir and the ink absorbing member and is configured to circulate the liquid ink from the ink reservoir to the ink absorbing member, the inlet forming part defining a plurality of inlets in the circulation path.

5. The writing tool according to claim 4, wherein the inlet forming part includes at least one partition part that partitions an inside of the circulation path into a plurality of regions, and the plurality of inlets are respectively formed by the plurality of regions that are partitioned by the at least one partition part in the circulation path.

6. The writing tool according to claim 5, wherein the partition part extends in a direction orthogonal to a central line of the circulation path.

* * * * *